US006273148B1

(12) United States Patent
Debaes et al.

(10) Patent No.: US 6,273,148 B1
(45) Date of Patent: Aug. 14, 2001

(54) METHOD FOR FACE-TO-FACE WEAVING PILE FABRICS

(75) Inventors: Johnny Debaes, Moorslede; Ludo Smissaert, Assebroek, both of (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/468,300

(22) Filed: Dec. 21, 1999

(30) Foreign Application Priority Data

Dec. 21, 1998 (BE) ..... 09800912

(51) Int. Cl.[7] ..... D03D 27/06

(52) U.S. Cl. ..... 139/402; 139/21; 139/37; 139/116.5; 139/404; 139/405

(58) Field of Search ..... 139/21, 37, 116.5, 139/391, 397, 404, 405, 402

(56) References Cited

FOREIGN PATENT DOCUMENTS 0628649 12/1994 (EP) .
0805227 11/1997 (EP) .
745059 5/1933 (FR) .

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

With a method for face-to-face weaving pile fabrics, whereby weft threads (1–6) are brought between warp threads (7–12) of a series of warp thread systems so that two backing fabrics (21), (22) are woven located one above the other with tension warp threads (7), (10) and dead pile warp threads (13–20) inwoven in the backing fabrics, whereby pile warp threads (13, 14, 18, 20) in each backing fabric form respective pile loops around first (1), (4) and around second weft threads (2), (5) which respectively run along the back and along the pile side of a tension warp thread (7), (10), and whereby the pile-forming pile warp threads (13, 14, 18, 20) are cut through between the backing fabrics, the dead pile warp threads (13–20), running along the pile side of the second weft threads (2), (5), are inwoven.

Because of this the inwoven dead pile warp threads (13–20) are prevented from being pushed through to the back of the fabric by the second weft threads (2), (5), and a latex layer applied to the back can penetrate well to the pile loops which have been formed around these second weft threads (2), (5).

15 Claims, 3 Drawing Sheets

METHOD FOR FACE-TO-FACE WEAVING PILE FABRICS

This invention relates to a method for weaving pile fabrics, whereby weft threads are brought between warp threads of a series of warp thread systems so that two backing fabrics are woven located one above the other, and whereby in a number of warp thread systems dead pile warp threads and tension warp threads are inwoven in the backing fabrics, and at least one pile warp thread is pile-loop-formingly passed around a weft thread alternately in the top and the bottom backing fabric, so that in each backing fabric respective pile loops are formed around first and second weft threads which run respectively along the back and along the pile side of a tension warp thread, and whereby the pile-forming pile warp threads are cut through between the backing fabrics.

This invention also relates to pile fabrics which are woven according to such a method.

Carpet weaving on a face-to-face weaving machine according to the above described weaving method is known.

In each warp thread system for each backing fabric a tension warp thread and two binding warp threads are provided. The backing fabrics are so woven that in each warp thread system alternately along the back and along the pile side of the tension warp thread a respective weft thread is inwoven by the two binding warp threads. These binding warp threads cross each other repeatedly so that in each case between two successive crossings they enclose a weft thread running along the back of the tension warp thread and a weft thread running along the pile side of the tension warp thread.

Per warp thread system a number of pile warp threads are provided. In order to form pile a pile warp thread is passed around a weft thread alternately in the top and the bottom backing fabric. This occurs according to a one-shot weave so that in each pile fabric a respective pile loop is formed around each weft thread. The successive pile loops are therefore alternately formed around a weft thread running along the back of the tension warp thread and around a weft thread running along the pile side of the tension warp thread.

In this specification and in the claims attached hereto a weft thread running along the back of the tension warp thread, around which a pile loop is formed, is called "a first weft thread", and a weft thread running along the pile side of the tension warp thread, around which a pile loop is formed, is called "a second weft thread".

The non-pile-forming pile warp threads or parts of pile warp threads, referred to by the term "dead pile warp threads" in that which follows, are inwoven in these backing fabrics divided between the top and the bottom backing fabric. These dead pile warp threads therefore come to lie next to the tension warp threads, between the successive weft threads.

The pile-forming pile warp threads are finally cut through between the two backing fabrics so that two separate pile fabrics are obtained.

This weaving method can be utilized on a single rapier weaving machine and on a double rapier weaving machine. In the latter case in the course of the successive weft insertion cycles alternately the top and the bottom weft insertion means is disengaged.

This weaving method and the fabrics manufactured according to this weaving method however have the following disadvantages:

The second weft threads running along the pile side have the tendency to push the inwoven dead pile warp threads through to the back of the carpet. Because of this the colors of the inwoven dead pile warp threads are visible on the back of the pile fabric. A consequence of this is that a pattern design formed in the pile fabric is less clearly visible on the back. A pile fabric is because of this considered as a fabric of less high quality.

It is also customary to improve the pile loop fastness of these pile fabrics by applying a latex layer on the back. The latex layer does not penetrate to the pile loops which have been formed around the second weft threads running along the pile side. Because of this a good pile loop fastness cannot be achieved for these pile loops.

The purpose of this invention is to provide such a method according to which pile fabrics can be woven without the above described disadvantages.

This purpose is achieved according to this invention with a method for weaving pile fabrics with the characteristics mentioned in the first paragraph of this specification, whereby the dead pile warp threads, running along the pile side of the second weft threads, are inwoven.

With a pile fabric woven according to this method the first and the second weft threads run along the back of the dead pile warp threads, through which these pile warp threads are not pushed through to the back of the fabric. The pattern design can because of this be discerned very clearly and perfectly on the back of the fabric. Furthermore the pile loops formed around the second weft threads now lie almost against the tension warp thread, so that a latex layer applied on the back of the pile fabric can penetrate much better to these pile loops. The pile loop fastness of these pile loops is because of this considerably improved.

With the method according to this invention third weft threads are preferably inwoven in each backing fabric, which run along the pile side of the dead pile warp threads. The dead pile warp threads are thus inwoven between the second and the third weft threads.

According to a preferred method according to this invention each third weft thread is provided between the tufts of a respective pile loop. Furthermore in each backing fabric a pile loop can be formed alternately around a first and around a second weft thread.

The method is preferably so implemented that each backing fabric comprises successive groups of weft threads, which comprise a first, a second, and a third weft thread.

If furthermore a respective pile loop is formed around the first and around the second weft thread of each group a pile fabric is obtained with a maximum pile density.

Very preferred pile fabrics are obtained if per warp thread system for each backing fabric two binding warp threads are provided so that these binding warp threads cross each other repeatedly, and so that a group of weft threads extends in each opening between two successive crossings of these binding warp threads.

For example successive series of six weft threads can be inserted on a weaving machine, whereby each series comprises a first, a second and a third weft thread of the top backing fabric, and a first, a second and a third weft thread of the bottom backing fabric, and whereby per weft insertion cycle in each case one weft thread is inserted.

The positions of a pile-forming pile warp thread in relation to the successive weft threads can with this method in each case be repeated after the insertion of a series of six weft threads, therefore after six weft insertion cycles. The pile-forming pile warp threads therefore have a repeat of 6 weft insertion cycles.

If the binding warp threads in each backing fabric run alternately above and below a group of weft threads, then their positions in relation to the successive weft threads are repeated after the insertion of two series of weft threads or after 12 weft insertion cycles. The binding warp threads therefore have a repeat of 12 weft insertion cycles. The weaving machine must in this case be provided with weaving frames with an operating repeat of 12 weft insertion cycles.

This method can be utilized on a weaving machine with one weft insertion means, such as e.g. a single rapier weaving machine.

By so inserting a series of weft threads successively a third weft thread is preferably inserted in the top backing fabric, a first weft thread in the top backing fabric, a second weft thread in the bottom fabric, a second weft thread in the top backing fabric, a first weft thread in the bottom backing fabric, and a third weft thread in the bottom backing fabric.

The method according to this invention can however be performed faster and therefore more economically if the six weft threads of a series on a weaving machine are inserted in the course of less than six successive weft insertion cycles. The six weft threads can for example be inserted in the course of four successive weft insertion cycles, whereby in the course of two of these insertion cycles in each case two weft threads are inserted, and in the course of the other two weft insertion cycles in each case one weft thread is inserted.

Weaving according to this weaving method progresses 1.5 times faster than weaving according to a method whereby per weft insertion cycle one weft thread is inserted. With this method the working pile warp threads have a repeat of four weft insertion cycles. The binding warp threads have a repeat of eight weft insertion cycles, so that the weaving frames can work with an operating repeat of eight weft insertion cycles.

If this method is to be utilized a weaving machine is necessary with weft insertion means which are provided for inserting at least two weft threads per weft insertion cycle.

By so inserting a series of weft threads preferably on the one hand the first and the third weft thread of the top backing fabric, and on the other hand the first and the third weft thread of the bottom backing fabric are inserted together in the course of respective weft insertion cycles, while the second weft thread of the bottom backing fabric and the second weft thread of the top backing fabric are inserted in the course of different weft insertion cycles.

Preferably two weft threads are then inserted in the course of the first and the fourth insertion cycle.

The method is utilized in a very efficient manner on a weaving machine with weft insertion means which are provided for inserting a respective weft thread per weft insertion cycle at least at three different levels.

The first and the third weft thread of the top fabric can then be inserted together, respectively at the top and at the middle insertion level, while at the bottom insertion level no weft thread is inserted. The second weft thread of the bottom backing fabric and the second weft thread of the top backing fabric can respectively be inserted at the bottom and the top insertion level while at the two other insertion levels no weft thread is inserted. The first and the third weft thread of the bottom backing fabric can also be inserted together, respectively at the middle and at the bottom insertion level, while at the top insertion level no weft thread is inserted.

This method offers the advantage that the dead pile warp threads can always be held at the same height between the insertion levels. In the course of the successive weft insertion cycles the dead pile warp threads which have to be inwoven in the top backing fabric can be held between the top and the middle insertion level, while the dead pile warp threads which have to be inwoven in the bottom backing fabric can be held between the middle and the bottom insertion level.

The dead pile warp threads are because of this less stressed. The device for positioning the pile warp threads in relation to the weft insertion levels (e.g. a jacquard machine) will only have to position the pile-forming pile warp threads, and will therefore be less stressed and consume less energy.

Preferably during the operation of this weaving machine at least at one insertion level no weft thread is inserted by disengaging the weft insertion means in question or by preventing this weft insertion means from being able to take along a weft thread.

In the following two possible weaving methods according to this invention are described in greater detail. This specification only serves to explain further the characteristics of the method and the pile fabrics according to the invention, and to specify further properties and distinctive features thereof, and cannot therefore be regarded as a restriction on the protection claimed for this invention in the claims of this patent application.

In this specification reference is made by means of reference numbers to the figures attached hereto. Of these figures, FIG. 1 is a schematic cross-section according to the warp direction of a face-to-face pile fabric, during the weaving thereof according to a first method according to this invention, on a single rapier face-to-face weaving machine;

Figure 5:
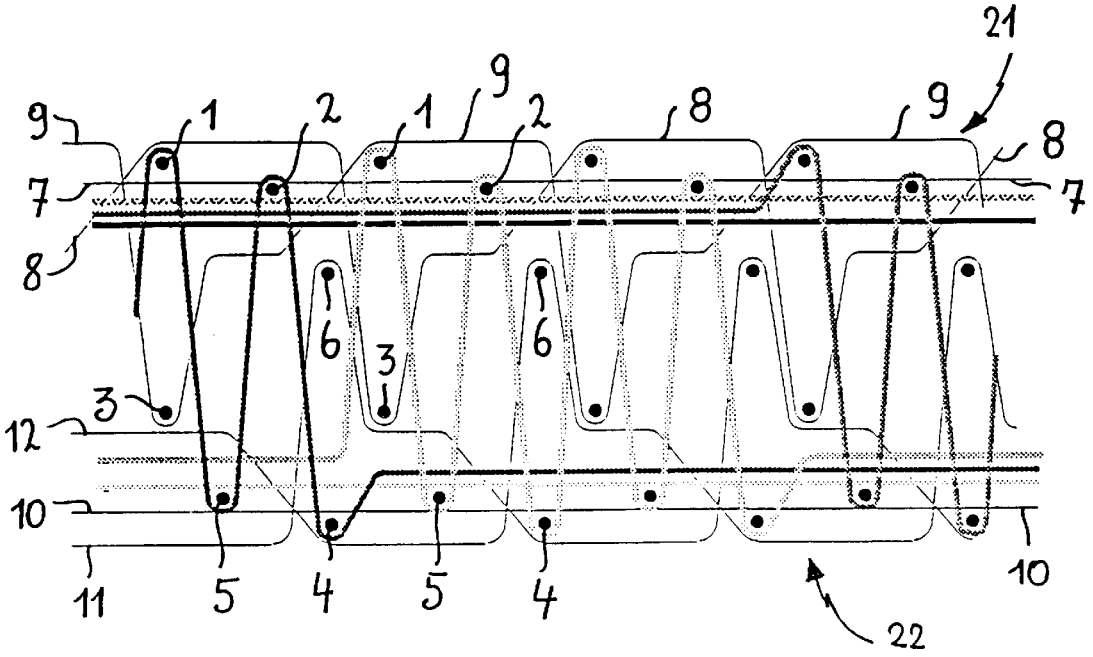
Figure 6:
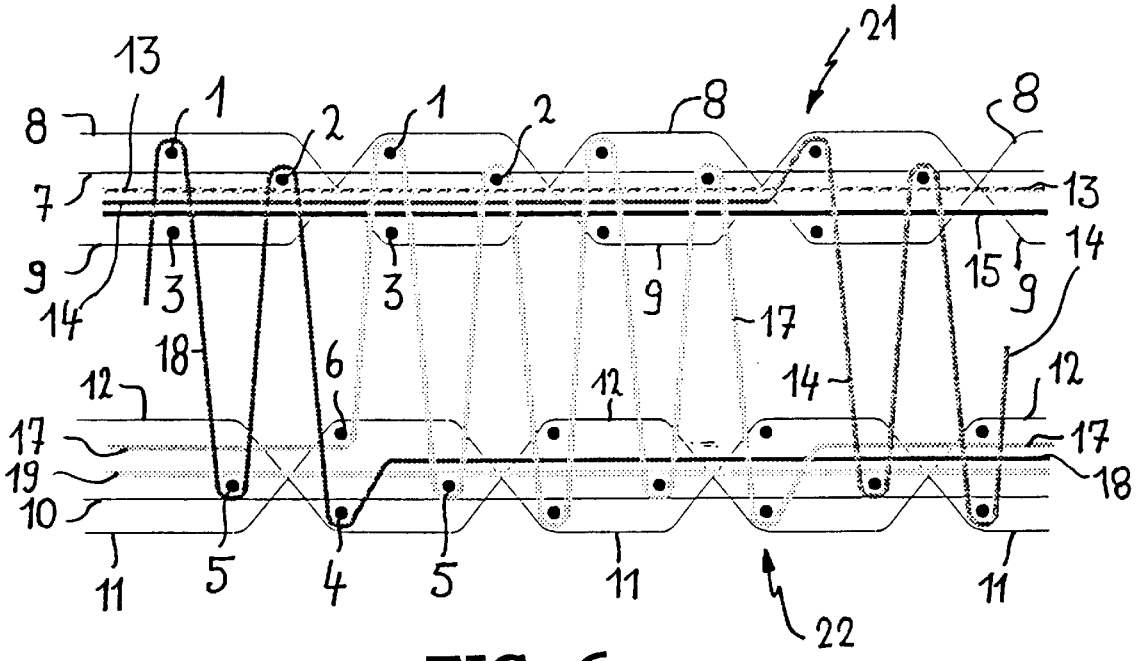

FIG. 5 is a schematic cross-section according to a fourth method according to this invention, on a double rapier face-to-face weaving machine, in which the weft threads are represented in the location where they are inserted; and FIG. 6 is a schematic cross-section of the face-to-face fabric according to FIG. 5, in which the weft threads are represented in the location where they are inwoven in the fabric.

Figure 1:
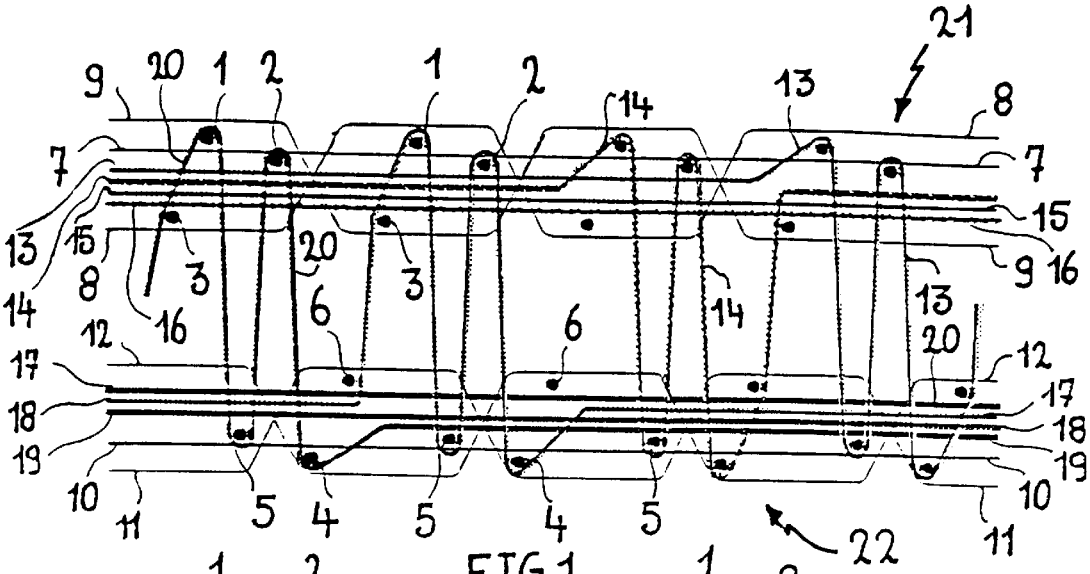

On a single rapier face-to-face weaving machine weft threads (1–6) are in successive sheds brought between the warp threads (7–20) of a series of warp thread systems, so that two backing fabrics (21), (22) are woven located one above the other, while pile warp threads (13, 14, 20) are alternately passed around a weft thread (1), (2) of the top backing fabric (21) and around a weft thread (4), (5) of the bottom backing fabric (22), so that respective pile loops are formed (see FIG. 1).

Two tension warp threads (7), (10), four binding warp threads (8), (9), (11), (12), and eight pile warp threads (13–20) are provided in each warp thread system. During the operation of the weaving machine in the course of successive weft insertion cycles in each case one weft thread (1), (2), (3), (4), (5), (6) is brought to a fixed insertion level between the warp threads (7–20). Each warp thread is in each case brought into the correct position (above or below this insertion level) prior to the insertion of a weft thread in order to weave the face-to-face pile fabric represented in FIG. 1. The positioning of the pile warp threads can for example be effected by a jacquard machine.

Two backing fabrics (21), (22) are woven located one above the other with tension warp threads (7), (10) and inwoven dead pile warp threads (13–20) . Per warp thread system the warp threads (7–20) are so positioned that in each backing fabric (21), (22) one tension warp thread (7), (10) and the non-pile-forming parts of four pile warp threads (13–16), (17–20) are inwoven, and that in each backing fabric (21), (22) successive groups of three weft threads (1–3), (4–6) are inwoven in respective successive openings between two binding warp threads (8), (9); (11), (12).

The three successive weft threads (3, 1, 2) of each group in the top backing fabric (21) are moreover respectively inwoven along the pile side of the dead pile warp threads (13–16) and the tension warp thread (7), along the back of the dead pile warp threads (13–16) and the tension warp thread (7), and between the dead pile warp threads (13–16) and the tension warp thread (7).

The three successive weft threads (4, 6, 5) of each group in the bottom backing fabric (22) are moreover respectively inwoven along the back of the dead pile warp threads (17–20) and the tension warp thread (10), along the pile side of the dead pile warp threads (17–20) and the tension warp thread (10), and between the dead pile warp threads (17–20) and the tension warp thread (10).

In each warp thread system at least one pile warp thread (13, 14, 20) forms pile loops because of the fact that alternately in the top (21) and the bottom backing fabric (22) it is passed around a weft thread (1), (2), (4), (5). Moreover in each backing fabric around each weft thread (1), (4) which is located along the back of the tension warp thread (7), (10) (a first weft thread) and around each weft thread (2), (5) which is located between the tension warp thread (7), (10) and the dead pile warp threads (13–16), (17–20) (a second weft thread) a respective pile loop is formed. The successive pile loops are therefore alternately formed around a first (1), (4) and around a second (2), (5) weft thread.

The tufts of the pile loops which are formed around a first weft thread (1), (4), are on both sides of a weft thread (3), (6) which runs along the pile side of the tension warp thread (7), (10) and the dead pile warp threads (13–20) (a third warp thread).

The weft threads (1–6) inserted one after another can be divided into successive series of six successive weft threads, whereby the weft threads of each series respectively occupy the same positions in the fabrics. Of each series the successively inserted weft threads are so inwoven that in the fabrics they respectively become a third weft thread (3) in the top backing fabric, a first weft thread (1) in the top backing fabric, a second weft thread (5) in the bottom backing fabric, a second weft thread (2) in the top backing fabric, a first weft thread (4) in the bottom backing fabric, and a third weft thread (6) in the bottom backing fabric. With each series of weft threads (1–6) a first (1), (4), a second (2), (5) and a third weft thread (3), (6) is therefore inserted both in the top (21) and in the bottom backing fabric (22).

In the figures in each case a warp thread system is represented in which several pile warp threads (13, 14, 18, 20) in turn form pile loops.

The pile-forming pile warp threads (13, 14, 20) are cut through between the two backing fabrics (21), (22) so that two separate pile fabrics are obtained.

In these pile fabrics the dead pile warp threads (13–20) are not pushed through to the back, so that the pattern design formed by the pile warp threads is very perfectly and clearly discernible on the fabric back. The pile loop fastness of the pile loops which have been formed around the second weft threads (2), (5) can also be considerably improved in comparison to the existing pile fabrics of this type, since a latex layer (or any other fixing agent) applied to the fabric back can penetrate well to these pile loops.

Figure 2:
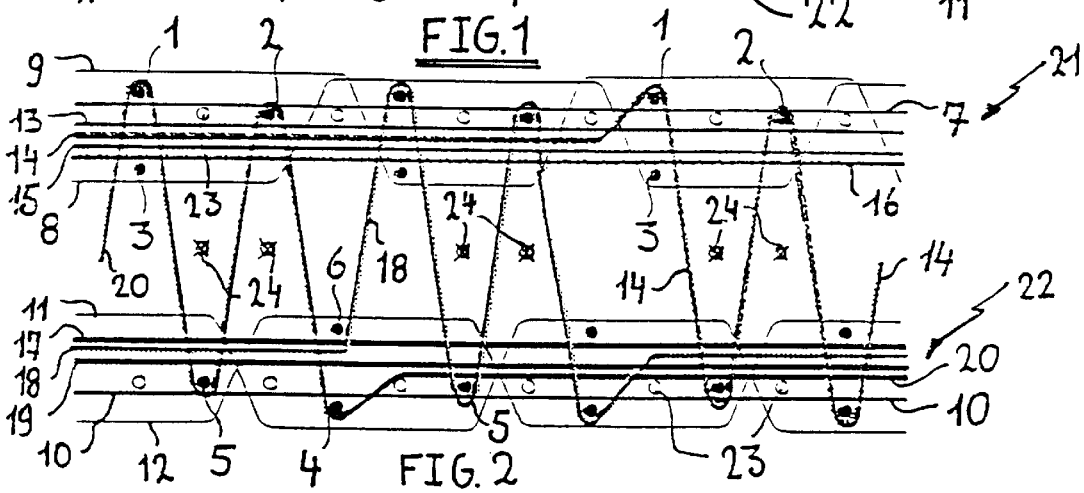
FIG. 2 is a schematic cross-section according to the warp direction of a face-to-face pile fabric, during the weaving thereof according to a second method according to this invention, on a triple rapier face-to-face weaving machine with indication of the insertion positions of non-inserted weft threads.
Figure 3:
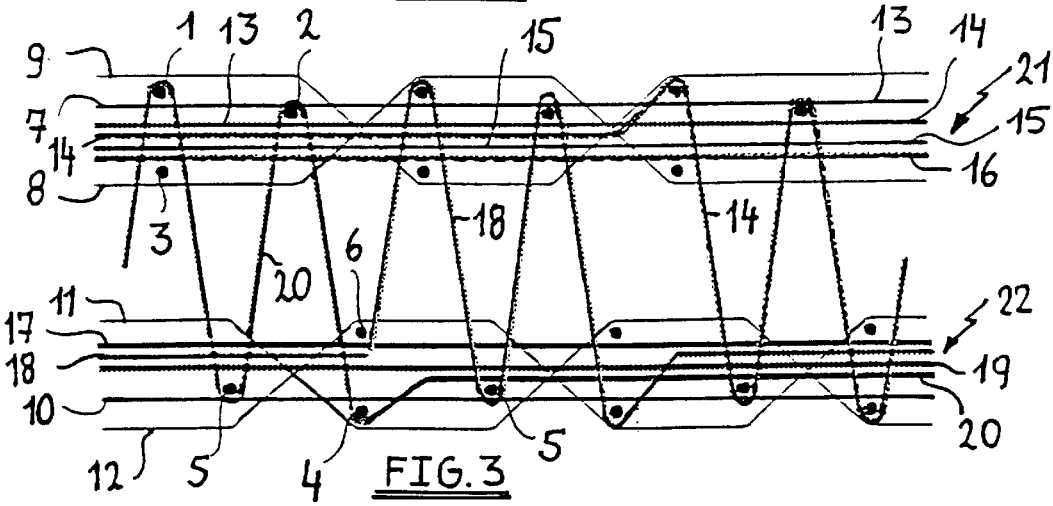
FIG. 3 is the same schematic cross-section as FIG. 2, but without indication of the insertion positions of non-inserted weft threads.

The method illustrated by FIGS. 2 and 3 differs from the method which has been described above with reference to FIG. 1, principally because of the fact that now on the one hand the first (1) and the third weft thread (3) of the top backing fabric (21), and on the other hand the first (4) and the third weft thread (6) of the bottom backing fabric (22) are inserted together one above the other in the course of the respective weft insertion cycles on a triple rapier face-to-face weaving machine. This weaving machine is provided in order in the course of each weft insertion cycle to insert a respective weft thread at a top, a middle and a bottom insertion level.

The above mentioned series of six weft threads is according to this method therefore inserted in the course of four successive weft insertion cycles. Because of this according to this method weaving can be effected 50% faster.

The insertion of a series of weft threads (1–6) occurs as follows:

- in the course of a first weft insertion cycle the first (1) and the third weft thread (3) for the top backing fabric (21) are inserted, respectively at the top and at the middle insertion level;
- in the course of a second weft insertion cycle the second weft thread (5) for the bottom backing fabric (22) is inserted at the bottom insertion level;
- in the course of a third weft insertion cycle the second weft thread (25) for the top backing fabric (21) is inserted at the top insertion level; and
- in the course of a fourth weft insertion cycle the first (4) and the third weft thread (6) for the bottom backing fabric (22) are inserted, respectively at the middle and at the bottom insertion level.

In the course of these four weft insertion cycles no weft thread has therefore to be inserted first at the bottom insertion level, subsequently at the top and the middle insertion level, thereafter at the middle and the bottom insertion level, and finally at the top insertion level. In order not to insert a weft thread at a specific insertion level the weft insertion means operating at that insertion level can be disengaged or it can be ensured that the operating weft insertion means does not have a weft thread presented to it. For the latter mentioned possibility the term weft cancellation is used.

In FIG. 2 the insertion positions of the non-inserted weft threads are indicated. At the insertion positions (23) indicated by a circle no weft thread is inserted by disengaging a weft insertion means. At the positions (24) which have been indicated by a crossed circle no weft thread is inserted through the application of weft cancellation.

According to this method the dead pile warp threads (13–16) inwoven in the top backing fabric can in the course of the successive weft insertion cycles be held at the same height, between the top and the middle insertion level. The dead pile warp threads (17–20) inwoven in the bottom backing fabric can in the course of the successive weft insertion cycles be held at the same height, between the middle and the bottom insertion level.

Figure 4:
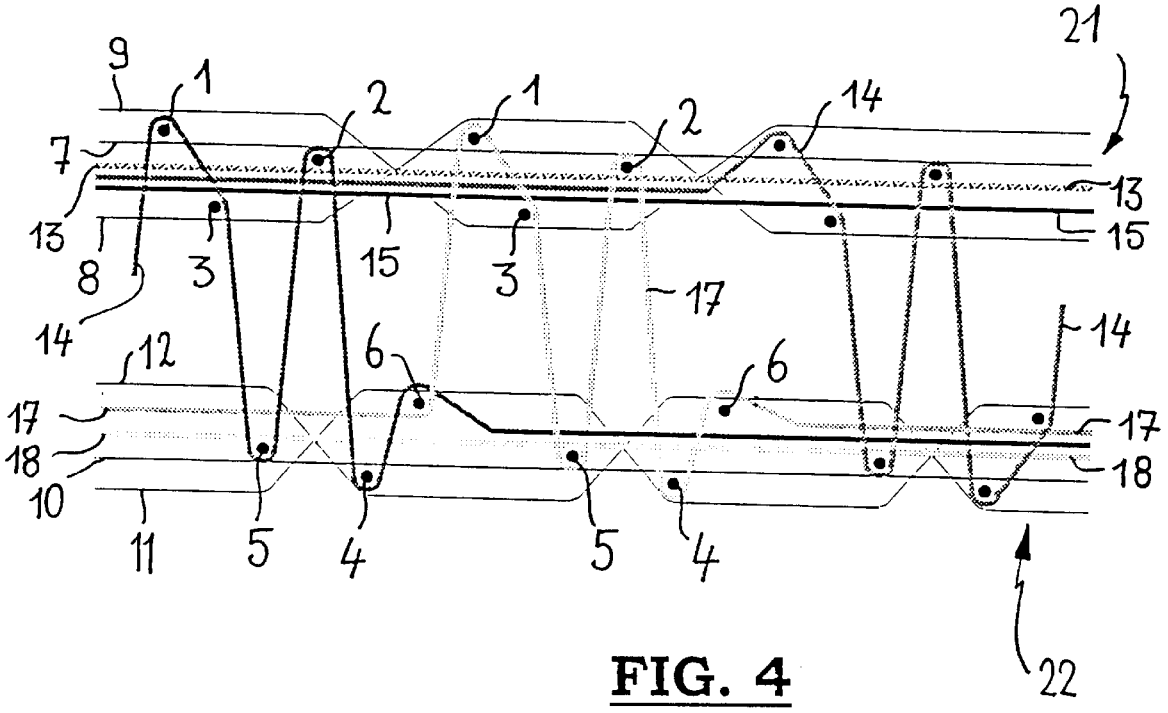
FIG. 4 is a schematic cross-section according to the warp direction of a face-to-face pile fabric, during the weaving thereof according to a third method according to this invention, on a single rapier face-to-face weaving machine.

The method illustrated by FIG. 4 is implemented on a single rapier face-to-face weaving machine. In successive sheds between warp threads (7–15, 17, 18) of a series of warp thread systems weft threads (1–6) are inserted, so that two backing fabrics (21), (22) are formed located one above the other, while pile warp threads (13, 14, 15, 17, 18) are alternately passed around a weft thread (1), (2) of the top backing fabric (21) and around a weft thread (4), (5) of the bottom backing fabric (22), so that respective pile loops are formed.

Each warp thread system comprises two tension warp threads (7), (10), four binding warp threads (8), (9) (11), (12) and five pile warp threads (13), (14), (15), (17), (18). In the course of successive waft insertion cycles of the weaving machine in each case one weft thread (1), (2), (3), (4), (5), (6) is brought to a fixed insertion level between the warp threads. These warp threads are positioned by a jacquard machine in relation to this insertion level, in order to weave the face-to-face pile fabric represented in FIG. 4.

Two backing fabrics (21), (22) are woven located one above the other, in which successive groups of three weft threads (1–3) (4–6) are inwoven in respective successive openings between two binding warp threads (8), (9); (11), (12).

The three successive weft threads (1, 3, 2) of each group in the top backing fabric (21) are moreover respectively inwoven along the back of the dead pile warp threads (13, 14, 15, 17, 18) and the tension warp thread (7), along the pile side of the dead pile warp threads (13, 14, 15, 17, 18) and the tension warp thread (7) and between the dead pile warp threads (13, 14, 15, 17, 18) and the tension warp thread (7).

The positions of the successive weft threads (5), (4), (6) of each group in the bottom fabric (22) are the same as in the top fabric (21).

The weft threads (1–6) inserted one after another can be divided into successive series of six successive weft threads. These successive weft threads are in each case so inwoven that they respectively form a successive first weft thread (1) in the top backing fabric, a third weft thread (3) in the top backing fabric, a second weft thread (5) in the bottom backing fabric, a second weft thread (2) in the top backing fabric, a first weft thread (4) in the bottom backing fabric, and a third weft thread (6) in the bottom backing fabric.

The weave implemented according to this method differs from the one according to FIG. 1 because of the fact that in each group of weft threads of the top backing fabric first the first weft thread (1) and thereafter the third weft thread (3) is inserted, while this is the other way around with the method according to FIG. 1.

According to this single-bobbin weaving method (FIG. 4) the weft threads (1–6) are each separately inserted successively in a single or double shed.

An advantage of this weaving method is that it can be implemented with a two-position open-shed jacquard machine. With single-bobbin weaving with a double rapier weaving machine lancets can be utilized for better controlling the pile height.

The productivity of this weaving method however leaves something to be desired. Three machine revolutions are necessary in order to form two pile rows. The repeat of the warp threads of the backing fabric is 12. Such a long repeat is difficult to implement with a cam drum.

The method illustrated by FIGS. 5 and 6 is implemented on a double rapier face-to-face weaving machine. Each series of six weft threads (1–6) is inserted in the course of four successive weft insertion cycles. In the first insertion cycle the first (1) and the third weft thread (3) of the top backing fabric (21) are inserted together one above the other. These weft threads (1), (3) are inserted in the shed for the top fabric (21), but the first weft thread (1) is inserted at the level of the top fabric (21) while the third weft thread (3) is inserted at the level of the bottom fabric (22).

The binding warp thread (9) of the top fabric (21) is then in a "bottom" position, below the insertion level at the level of the bottom fabric (22). This binding warp thread (9) then pulls the third weft thread (3) toward the top backing fabric (21), as appears from FIG. 6.

In the second insertion cycle the second weft thread (5) is inserted in the bottom backing fabric (22). In the third insertion cycle following thereafter the second weft thread (2) is inserted in the top backing fabric (21).

In the fourth insertion cycle the first (4) and the third weft thread (6) of the bottom backing fabric are inserted together one above the other. These weft threads (4), (6) are inserted in the shed for the bottom fabric (22), but the first weft thread (4) is inserted at the level of the bottom fabric (22), while the third weft thread (6) is inserted at the level of the top fabric (21). The binding warp thread (11) of the bottom fabric (22) is then in a "top" position above the top insertion level, and pulls the third weft thread (6) toward the bottom backing fabric (22), as appears from FIG. 6.

The advantage of this weaving method is that it can be implemented with a double rapier weaving machine, provided with a normal three-position jacquard machine. The repeat of the backing weave is 8, which can be well implemented with a cam drum.

This weaving method however has the disadvantage that the sheds for the binding warp threads have to be cyclically very large. This is not ideal for a good pile formation and more specifically for obtaining a uniform pile height. With this method the use of lancets is not possible, since weft threads have to be able to move from the level of the top fabric to the level of the bottom fabric, and vice versa. The use of lancets is also not possible with the above described triple rapier weaving method (FIGS. 2 and 3).

What is claimed is:

1. Method for weaving pile fabrics comprising bringing weft threads between warp threads of a series of warp thread systems for weaving two backing fabrics as top and bottom backing fabrics located one above another, inweaving in the warp thread systems dead pile warp threads and tension warp threads in the backing fabrics, passing at least one pile warp thread around a weft thread alternately in the top and the bottom backing fabric for forming a pile loop, forming in each backing fabric respective pile loops around first and around second weft threads running respectively along a back side and along a pile side of a tension warp thread, cutting through the pile-forming pile warp threads between the backing fabrics, and inweaving the dead pile warp threads running along the pile side of the second weft threads.

2. The method of claim 1, further comprising inweaving in each backing fabric third weft threads running along a pile side of the dead pile warp threads.

3. The method of claim 1, further comprising providing each third weft thread between tufts of a respective pile loop.

4. The method of claim 1, further comprising forming a pile loop in each backing fabric alternately around a first and around a second weft thread.

5. The method of claim 1, further comprising providing in each backing fabric successive groups of weft threads comprising a first, a second and a third weft thread.

6. The method of claim 5, further comprising forming a respective pile loop around the first and the second weft thread of each group.

7. The method of claim 5, further comprising providing in each warp thread system for each backing fabric two binding warp threads such that the two binding warp threads cross each other repeatedly, and extending a group of weft threads in each opening between two successive crossings of the two binding warp threads.

8. The method of claim 1, further comprising inserting successive series of six weft threads in a weaving machine, each series comprising a first, a second and a third weft thread of the top backing fabric, and a first, a second and a third weft thread of the bottom backing fabric, and inserting in each weft insertion cycle in each series at least one weft thread.

9. The method of claim 8, wherein the inserting the series of weft threads successively comprises inserting sequentially the third weft thread in the top backing fabric, the first weft thread in the top backing fabric, the second weft thread in the bottom fabric, the second weft thread in the top backing fabric, the first weft thread in the bottom backing fabric, and the third weft thread in the bottom backing fabric.

10. The method of claim 1, further comprising inserting a successive series of six weft threads on a weaving machine each series comprising a first, a second and a third weft thread of the top backing fabric, and a first, a second and a third weft thread of the bottom backing fabric, and inserting the six weft threads of the series during four successive weft insertion cycles, inserting during two of the four insertion cycles in each series two weft threads, and inserting during two other weft insertion cycles in each series at least one weft thread.

11. The method of claim 10, wherein the inserting the successive series comprises inserting together the first and the third weft thread of the top backing fabric and the first and the third weft thread of the bottom backing fabric during respective weft insertion cycles, and inserting the second weft thread of the bottom backing fabric and the second weft thread of the top backing fabric during different weft insertion cycles.

12. The method of claim 10, further comprising inserting two weft threads during a first and a fourth insertion cycle.

13. The method of claim 1, further comprising providing a weaving machine with weft insertion means and inserting a respective weft thread per weft insertion cycle at least at three different levels.

14. The method of claim 13, further comprising disengaging the weft insertion means during operation of the weaving machine at least at one insertion level to avoid a weft thread insertion.

15. The method of claim 13, further comprising preventing the weft insertion means from engaging the weft thread during operation of the weaving machine at least at one insertion level.

* * * * *